US006623044B1

(12) United States Patent
Guesnon et al.

(10) Patent No.: US 6,623,044 B1
(45) Date of Patent: Sep. 23, 2003

(54) RISER ELEMENT WITH INTEGRATED AUXILIARY PIPES

(75) Inventors: Jean Guesnon, Chatou (FR); Marcel Le Comte, Bezons (FR)

(73) Assignee: Institut Francais du Petrole, Rueil-Malmaison cedex (FR)

( * ) Notice: Subject to any disclaimer, the term of this patent is extended or adjusted under 35 U.S.C. 154(b) by 81 days.

(21) Appl. No.: 09/667,788

(22) Filed: Sep. 22, 2000

(30) Foreign Application Priority Data

Sep. 24, 1999 (FR) ..... 99 12033

(51) Int. Cl.[7] ..... F16L 39/00; F16L 55/00
(52) U.S. Cl. ..... 285/124.1; 285/114; 166/341
(58) Field of Search ..... 285/124.1–124.5, 285/114; 166/241.1, 241.6, 341, 342, 348

(56) References Cited

U.S. PATENT DOCUMENTS

| | | | | | |
|---|---|---|---|---|---|
| 3,280,908 | A | * | 10/1966 | Todd | 166/6 |
| 3,354,951 | A | * | 11/1967 | Savage | 166/6 |
| 3,952,526 | A | | 4/1976 | Watkins | |
| 4,280,719 | A | * | 7/1981 | Daniel et al. | 285/377 |
| 4,374,595 | A | * | 2/1983 | Watkins | 285/124.1 |
| 4,487,434 | A | | 12/1984 | Roche | |
| 4,496,173 | A | | 1/1985 | Roche | |
| 4,514,245 | A | | 4/1985 | Chabrier | |
| 4,550,936 | A | * | 11/1985 | Haeber | 285/124.1 |
| 5,110,644 | A | | 5/1992 | Sparks | |
| 5,390,966 | A | * | 2/1995 | Cox | 285/124.1 |
| 5,992,893 | A | * | 11/1999 | Watkins | 285/18 |

FOREIGN PATENT DOCUMENTS

| | | | |
|---|---|---|---|
| EP | 147321 | | 7/1985 |
| FR | 2526517 | * | 5/1982 |
| GB | 1521133 | | 8/1978 |
| GB | 2138908 | | 10/1984 |
| GB | 2138909 | | 10/1984 |
| GB | 2322175 | | 8/1998 |

* cited by examiner

*Primary Examiner*—Eric K. Nicholson
(74) *Attorney, Agent, or Firm*—Antonelli, Terry, Stout & Kraus, LLP

(57) ABSTRACT

The present invention relates to a riser pipe element comprising a main tube (5), connection means (2) at both ends, at least one auxiliary pipe length (4) arranged substantially parallel to the tube. The auxiliary pipe length is secured at both ends to the connection means of the main tube so that the longitudinal mechanical stresses to which the connection means are subjected are distributed in the tube and in the pipe.

9 Claims, 2 Drawing Sheets

RISER ELEMENT WITH INTEGRATED AUXILIARY PIPES

FIELD OF THE INVENTION

The present invention relates to a riser pipe element comprising at least one pipe or auxiliary line integrated in the central tube. The present invention proposes a specific element insofar as the auxiliary line or lines are connected to the central tube of an element of the riser so that they take up the mechanical stresses, notably longitudinal, together with the central main tube.

BACKGROUND OF THE INVENTION

A drilling riser pipe consists of a set of tubular elements whose length ranges between 15 and 25 m (50 and 80 feet), assembled by connectors. The weight of these risers can be very great, which imposes suspension means of very high capacity at the surface and suitable dimensions for the central tube and the couplings.

Until now, auxiliary lines: kill lines, choke lines, are arranged around the central tube and comprise couplings that fit into one another, fastened to the connectors of the riser elements so that these high-pressure lines can allow a longitudinal play between two successive line elements, without disconnection however. It is not envisaged that these lines intended to allow high-pressure circulation of an effluent coming from a well or from the surface take part in the mechanical strength of the structure consisting of the riser pipe as a whole.

When drilling at water depths that can reach 3000 m, the dead weight of the auxiliary lines becomes very disadvantageous insofar as, for the same maximum operating pressure, the length of these lines imposes a greater inside diameter considering the necessity to limit pressure drops.

Modern calculation means have allowed to show the advantage afforded by making the auxiliary lines, kill lines, choke lines or booster lines, take part in the longitudinal mechanical strength of each riser element.

SUMMARY OF THE INVENTION

The present invention thus relates to a riser element comprising a main tube, connection means at both ends, at least one auxiliary pipe length arranged substantially parallel to said tube. The auxiliary pipe length is secured at both ends to the connection means of the main tube so that the longitudinal mechanical stresses to which the connection means are subjected are distributed in the tube and in the pipe.

One end of the auxiliary pipe can comprise a fastening device allowing a determined longitudinal play.

The play may not be zero in the absence of load on the element.

The auxiliary pipe can have one end running through a flange secured to a connector of the tube and it can comprise a dog limiting the displacement of said pipe in relation to the flange.

The play can correspond to the elongation of the main tube under a determined load value. The auxiliary pipe can be a steel tube hooped by reinforcing wire layers.

The main tube can be a steel tube hooped by reinforcing wire layers.

The reinforcing wires can be made of glass, carbon or aramid fibers coated in a polymer matrix.

BRIEF DESCRIPTION OF THE DRAWINGS

Other features and advantages of the present invention will be clear from reading the description hereafter of a non limitative example, with reference to the accompanying drawings wherein.

DETAILED DESCRIPTION

Figure 1A:
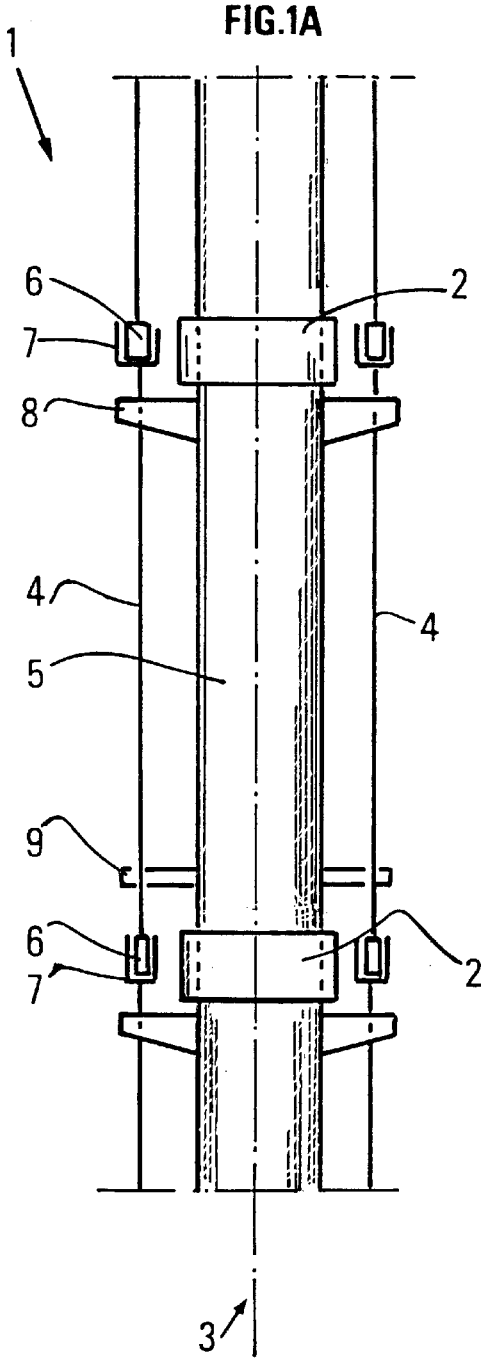
FIG. 1*a* and 1*b* diagrammatically show the principle of the invention.

In FIG. 1*a*, reference number 1 designates a tubular element of the riser. These elements 1 are assembled together by means of mechanical connectors 2 that can be, for example, those described in document EP-0,147,321 mentioned here by way of reference. Service lines or auxiliary lines are arranged parallel to axis 3 of the column so as to be <<integrated>> in the riser element. Reference number 4 designates a tubular line having the same length as element 1, which is automatically connected to the element of the upper or lower line when elements 1 are assembled by connectors 2. There are at least two lines 4 arranged on the periphery of main tube 5. These lines are referred to as kill line and choke line, and they are used for ensuring the safety of the well during inflow control procedures in the well. Each auxiliary pipe element comprises, at both ends, male and female end pieces bearing reference numbers 6 and 7 respectively. They tightly cooperate with the end pieces of the upper and of the lower element, with a certain axial play considering the elongation of main central tube 5 and the effects of the outside and inside pressures on the main tube and on the auxiliary lines. The upper end, which is generally the end close to female coupling 7, is tightly connected by fastening means 8 to the upper coupling 2 of element 1. On the other hand, lower fastening means 9 hold up tube 4 with a certain longitudinal play whose function is described more precisely in connection with FIG. 1*b*.

Figure 1B:
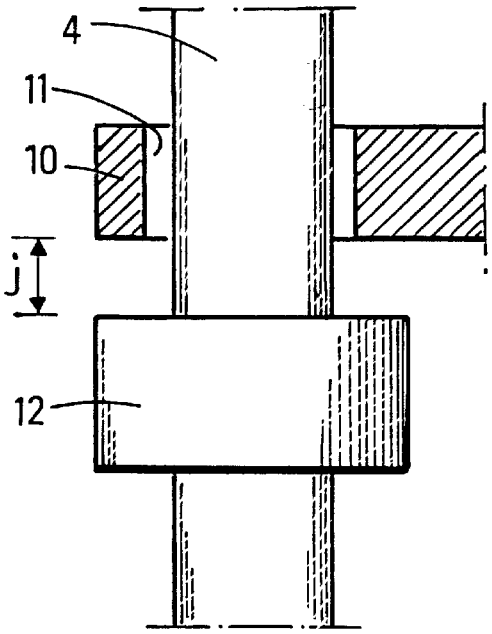

FIG. 1*b* illustrates the principle of the lower fastening device of the auxiliary lines. Tube 4 runs through a guide allowing the tube to slide, for example a plate or flange 10 pierced with an orifice 11 whose diameter substantially corresponds to the outside diameter of the tube of auxiliary line 4. A part shaped as a sleeve 12 is fastened to tube 4, below flange 10. The position of the sleeve in relation to the flange is such that thereis a play J between the lower face of the flange and the upper face of the sleeve when the integrated riser element is not subjected to a mechanical load.

Play J is so determined that, in operation, i.e. once the drilling riser is assembled, the weight stresses applied on each riser element are distributed in the main central tube and in the auxiliary tubes. Sleeve 12, or an equivalent stop system, can be adjustable so that the value of play J can be varied, for example according to the stress level expected in the tube element of the riser.

The method of linking the auxiliary lines, which allows an operating play, also allows to control the stresses that can be generated in the auxiliary pipes by the inside and/or outside pressure.

Figure 2:
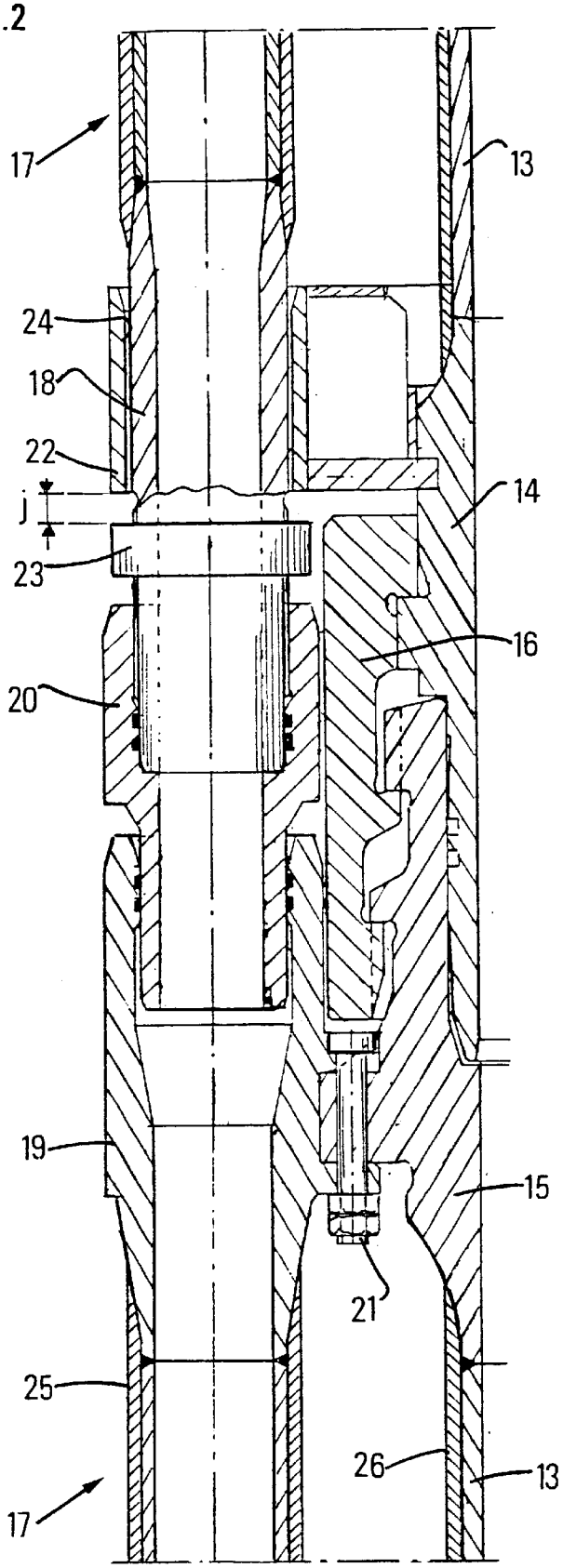
FIG. 2 shows an embodiment example from a riser connector.

FIG. 2 shows an embodiment example of the present invention. FIG. 2 is a longitudinal partial section of two assembled riser elements showing cooperation of the upper holding device and of the lower holding device of an auxiliary line. The connector of the riser element can be of bayonet, bolted flange or screwed joint type. Tube 13 is welded at both ends to male 14 and female 15 bayonet couplings. A ferrule 16 locks the connection by rotation. A kill line or a choke line 17 comprises welded end pieces 18 and 19. A kelly-saver sub 20 is inserted between the two end pieces 18 and 19. The upper end of auxiliary line 17 is fastened to upper coupling 15 by fastening means 21. In the present case, these fastening means consist of a screw-bolt connection. The lower end of auxiliary line 17 runs through a guide flange 22 comprising a cylindrical passage 24 in which the end of piece 18 can slide. End piece 18 carries a dog 23 arranged so as to provide a play J between dog 23 and the lower face of flange 22.

The present invention can be applied to auxiliary pipes 17 and/or to hooped main tubes, for example according to the reinforcing technique described in document U.S. Pat. No. 4,514,245 mentioned here by way of reference. This technique has the advantage of allowing to reduce the weight of the riser pipe. The hooping composite coating bears reference numbers 25 and 26 for auxiliary line 17 and tube 13 respectively.

Thus, unlike the usual principles wherein the peripheral lines freely slide at their ends (a dog is sometimes present to prevent disconnection), the tubes are locked at the end pieces thereof by dogs which rest against a very rigid and resistant support plate itself secured to the main tube via the connector. When the riser is at rest (for example during storage), the dog is adjusted so as not to induce any stress in the tubes. On the other hand, as soon as it is tensioned (under the action of its own weight during operation and under the action of tensioners during drilling), the dogs start working and distribute the tension in the various tubes in proportion to the steel section thereof It is thus possible to reduce the section of the main tube, which produces a very beneficial effect on the mass and on the weight in the water of the joints and finally on the mechanical behaviour of the riser.

During service, the tension in the various tubes is also distributed according to their particular working conditions (tension, flexion, pressure, temperature, buckling), the assembly must be designed and dimensioned so that the stresses induced in the various tubes remain below the API limits. Many load combinations must be considered. It can be noted that this integration does not change the workload of the connector, but that it however changes the course thereof.

Calculations show that it is possible to envisage dividing by about two the maximum thickness of the main tube (½"(12.7 mm) instead of ⅞"(22.225 mm) in the upper part of the riser in the most severe cases currently envisaged). For a 3000-m long riser, this can represent an additional reduction at least equal to 170 t of the total mass of the main tube and 100 t of the mass of the floats. This calculation was made by considering four peripheral steel lines of equal dimensions (4½"ID-½"WT), which implies reinforcing the two lines, kill line and choke line, by hooping. It can be noted that the hooped tubes and the principle of the invention are advantageously complementary and that the mass reduction adds thereto. If one considers the possibility of reinforcing the main tube itself by hooping so that it can withstand the mud pressure more efficiently (thickness maintained at ½"(12.7 mm) over the total length), the mass gain in relation to the conventional version is 260 t for the steel and 220 t for the floats. The total mass of the 3000-m long riser is thus brought back below 2000 t, against more than 3000 t in the conventional all-steel concept.

What is claimed is:

1. A riser pipe element comprising a main tube comprising a plurality of elements, connection means connecting ends of the elements of the main tube, at least one auxiliary pipe length each comprising a plurality of sections arranged substantially parallel to said main tube, wherein said connection means are subjected to tension stresses, and fastening means securing adjacent ends of sections of said auxiliary pipe length to said connection means so as to distribute tension stresses in the main tube and the auxiliary pipe when the riser pipe element is tensioned.

2. A riser pipe element as claimed in claim 1, wherein one end of said auxiliary pipe comprises a fastening device allowing a determined longitudinal play.

3. A riser pipe element as claimed in claim 2, wherein said play is not zero in the absence of load on said element.

4. A riser pipe element as claimed in claim 1, wherein said auxiliary pipe has one end running through a flange secured to a connector of the tube and comprises a dog limiting the displacement of said pipe in relation to the flange.

5. A riser pipe element as claimed in claim 1, wherein said play corresponds to the elongation of the main tube under a determined load value.

6. A riser pipe element as claimed in claim 1, wherein said auxiliary pipe is a steel tube hooped by reinforcing wire layers.

7. A riser pipe element as claimed in claim 1, wherein said main tube is a steel tube hooped by reinforcing wire layers.

8. A riser pipe element as claimed in claim 7, wherein said reinforcing wires are made of glass, carbon or aramid fibers coated in a polymer matrix.

9. A riser pipe element as claimed in claim 6, wherein said reinforcing wires are made of glass, carbon or aramid fibers coated in a polymer matrix.

* * * * *